US007670137B1

(12) United States Patent
Landry et al.

(10) Patent No.: US 7,670,137 B1
(45) Date of Patent: Mar. 2, 2010

(54) GAS PRESSURE IGNITION ASSEMBLY

(76) Inventors: Matthew B. Landry, 4400 Memorial Dr., Apt. 3067, Houston, TX (US) 77007; Kenneth Chauvin, P.O. Box 471, Schriever, LA (US) 70395; David Craig, 1272 Knollwood, Baton Rouge, LA (US) 70808

( * ) Notice: Subject to any disclaimer, the term of this patent is extended or adjusted under 35 U.S.C. 154(b) by 85 days.

(21) Appl. No.: 11/764,737

(22) Filed: Jun. 18, 2007

Related U.S. Application Data

(60) Provisional application No. 60/814,421, filed on Jun. 16, 2006.

(51) Int. Cl.
*F23N 5/00* (2006.01)

(52) U.S. Cl. ..... 431/254; 431/43; 431/46; 431/248; 431/70; 431/83

(58) Field of Classification Search ..... 431/254, 431/43, 46, 248, 70–72, 82–83
See application file for complete search history.

(56) References Cited

U.S. PATENT DOCUMENTS 3,909,186 A * 9/1975 Kidwell et al. ..... 431/254
6,517,342 B2 * 2/2003 van der Veen ..... 431/72

* cited by examiner

*Primary Examiner*—Steven B McAllister
*Assistant Examiner*—Nikhil Mashruwala
(74) *Attorney, Agent, or Firm*—Carver, Darden, Koretzky, Tessier, Finn, Blossman & Areaux, LLC; Raymond G. Areaux; Ian C. Barras

(57) ABSTRACT

An automated ignition assembly for a gas-fueled appliance includes a pressure plate positioned between an upper bellows and a lower bellows, each of which is in selective communication with a fuel gas source. If fuel gas is directed to the lower bellows, gas within the upper bellows is diverted to an ignition site; as the lower bellows inflates, it lifts the pressure plate and an associated linkage assembly to engage a piezo igniter, which creates a spark at the ignition site. The lower bellows is then deflated and the upper bellows is inflated to again engage the piezo igniter. Once a flame has been generated, or if a flame has not been generated within a predetermined time period, an automated valve disables fuel gas flow to the bellows.

15 Claims, 6 Drawing Sheets

GAS PRESSURE IGNITION ASSEMBLY

CROSS REFERENCE TO RELATED APPLICATIONS

This application is entitled to the benefit of provisional application No. 60/814,421 filed on Jun. 16, 2006, the specification of which is incorporated herein by reference.

BACKGROUND OF THE INVENTION

The present invention relates to an igniter for a gas lamp or similar appliance that automatically creates an ignition spark without the need for an external power source.

DESCRIPTION OF THE PRIOR ART

Gas lamps and other similar gas-fueled appliances include a burner that must be ignited prior to operation. Many of these appliances include electronic spark generators that create a spark proximal the burner. Due to their inherent complexity, electronic ignition systems are expensive to manufacture and assemble. Furthermore, they are complicated and laborious to install due to the need for wiring and other additional hardware, which also further increases the expense associated with their use. Finally, electronic ignition systems are only as reliable as the electrical source so that if the flame is extinguished and the power source is unavailable, the flame cannot be immediately reestablished.

Other gas-fueled appliances require that the burner be manually ignited using a torch or a match. However, the appliance is often positioned in an inaccessible location where manual ignition is not possible. Additionally, repeatedly igniting a burner in such fashion is laborious, time consuming and inconvenient.

A review of the prior art reveals at least one ignition assembly that is purported to overcome the disadvantages associated with conventional electronic and manual ignition procedures. For example, U.S. Pat. No. 6,517,342 issued to van der Veen discloses a gas pressure-driven igniter. However, the device is primarily designed for large scale applications such as gas-fired heaters and boilers. As such, the expansive design is totally unsuitable for gas lamps or other similar, smaller appliances. Accordingly, there is currently a need for a simpler, more convenient and safer means of igniting a gas-fueled appliance. The present invention overcomes the disadvantages associated with the various conventional gas ignition systems discussed above by providing an igniter that uses fuel-pressurized bellows to drive a piezo igniter that creates a spark at an ignition site.

SUMMARY OF THE INVENTION

An automated ignition assembly for a gas-fueled appliance includes a pressure plate positioned between an upper bellows and a lower bellows. Each of the bellows is alternately inflated with fuel gas to actuate a linkage assembly and a piezo igniter coupled therewith. The position of the linkage assembly and an associated gas flow direction valve dictates whether fuel gas is directed to either the upper bellows or the lower bellows. If gas is directed to the lower bellows, the pressure plate rises to lift the linkage assembly, which engages the piezo igniter to deliver a spark to an ignition site. As the lower bellows is inflated, gas within the upper bellows is diverted to the ignition site. The gas flow direction valve then deflates the lower bellows and inflates the upper bellows to again engage the piezo igniter. The inflation and deflation of the bellows continues until a flame is created at the ignition site. Once a flame has been generated, or if a flame has not been generated within a predetermined time period, an automated valve disables fuel gas flow to the bellows.

It is therefore an object of the present invention to provide an ignition assembly that eliminates the need for auxiliary power sources to ignite a flame.

It is another object of the present invention to provide an ignition assembly that eliminates the burden and inconvenience associated with manually igniting gas-fueled appliances.

It is yet another object of the present invention to provide an ignition assembly that is safer and less expensive than conventional ignition assemblies.

It is yet even another object of the present invention to provide an ignition assembly that eliminates the need to install electrical wiring and other hardware in order to operate a gas-fueled appliance. Other objects, features, and advantages of the present invention will become readily apparent from the following detailed description of the preferred embodiment when considered with the attached drawings and the appended claims.

DESCRIPTION OF THE PREFERRED EMBODIMENT

Figure 1:
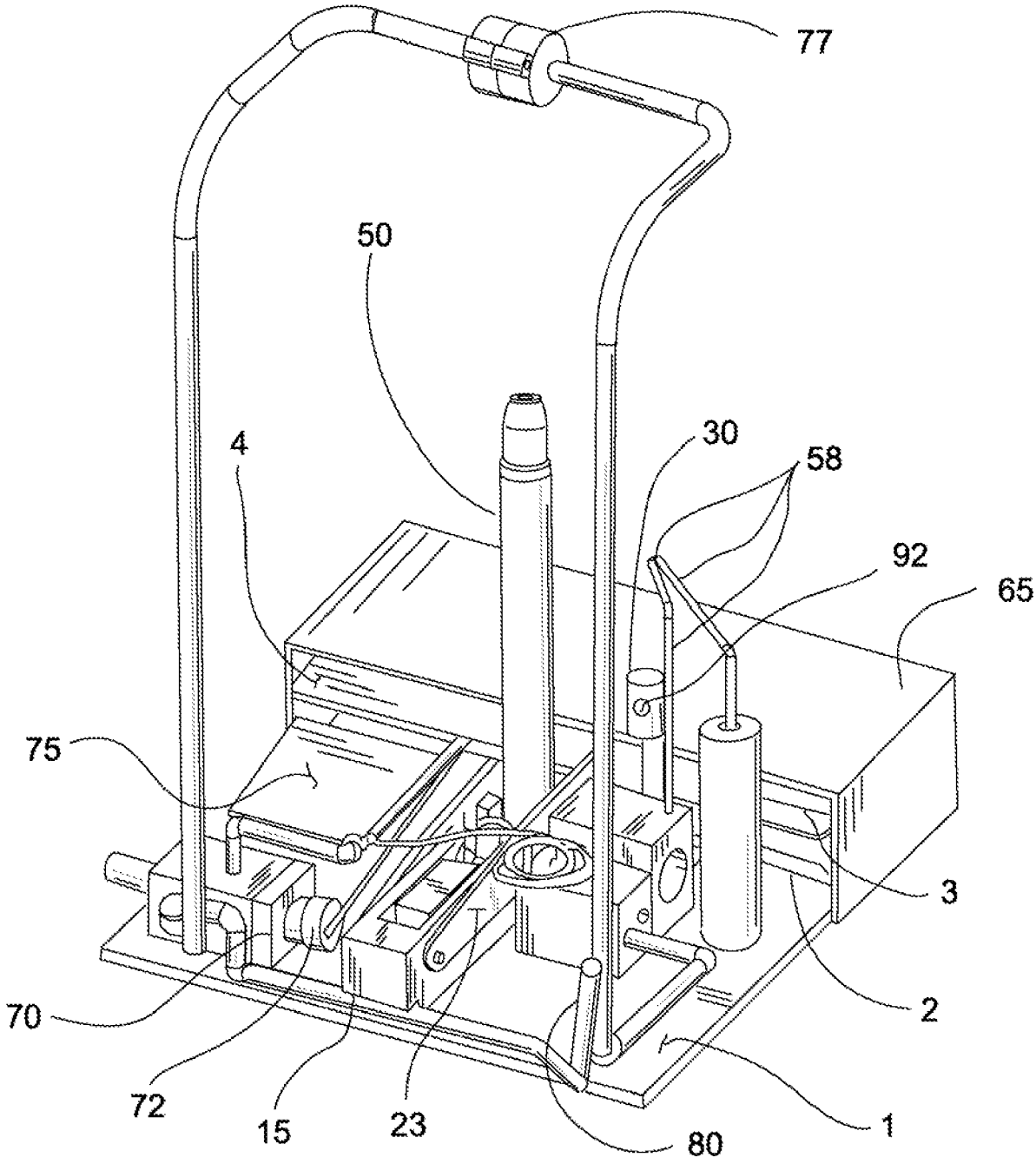
FIG. 1 is a perspective view of the ignition assembly according to the present invention.
Figure 2:
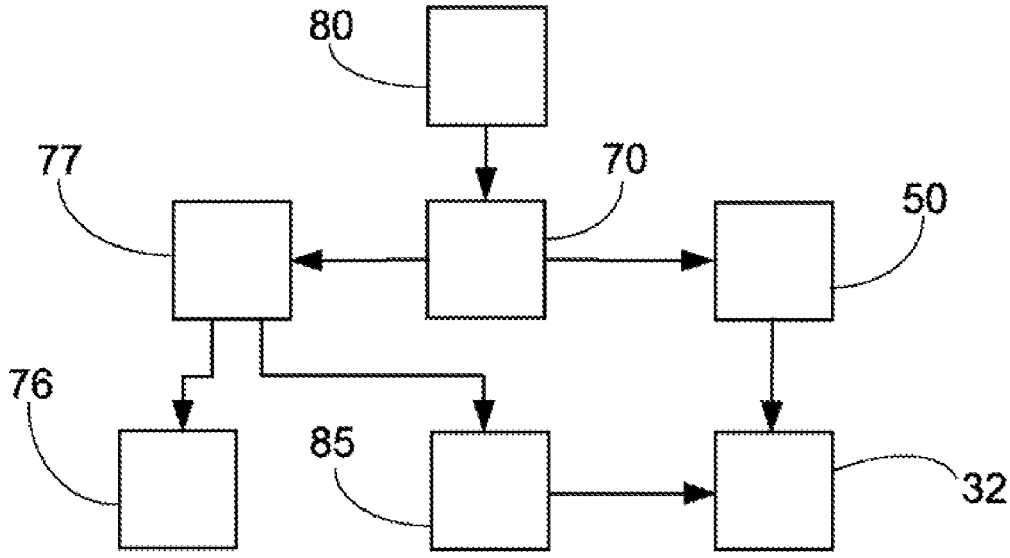
FIG. 2 is a schematic depicting the fuel gas flow through the various components of the ignition assembly.
Figure 3:
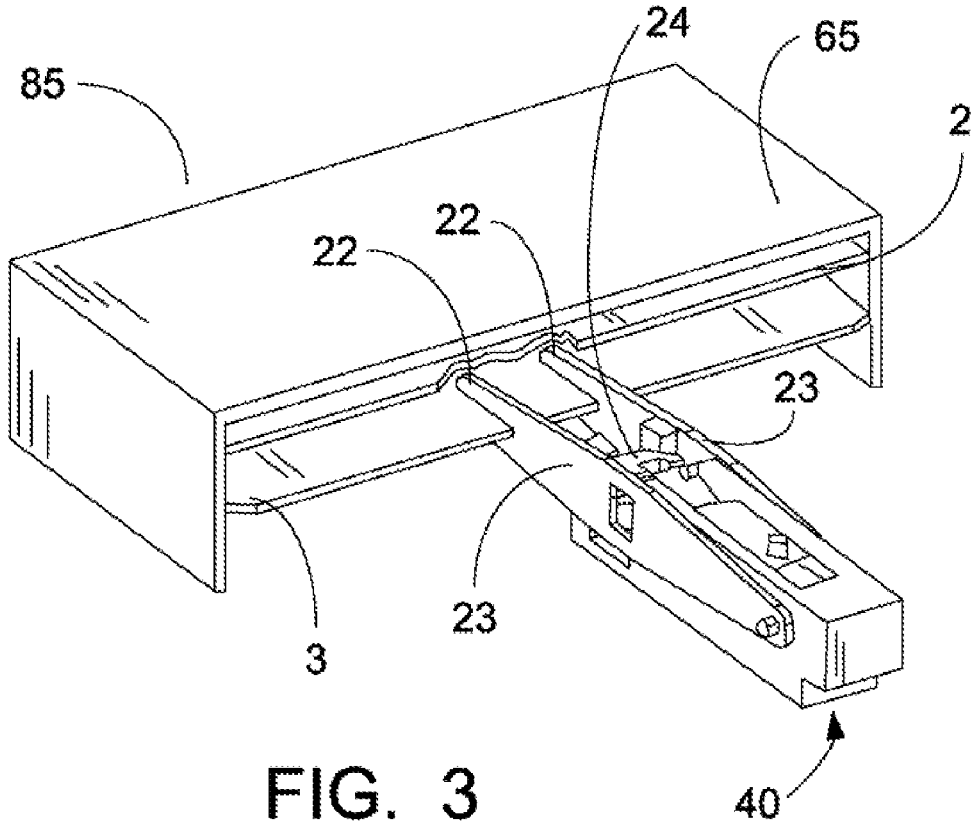
FIG. 3 depicts the spark generation assembly.
Figure 4:
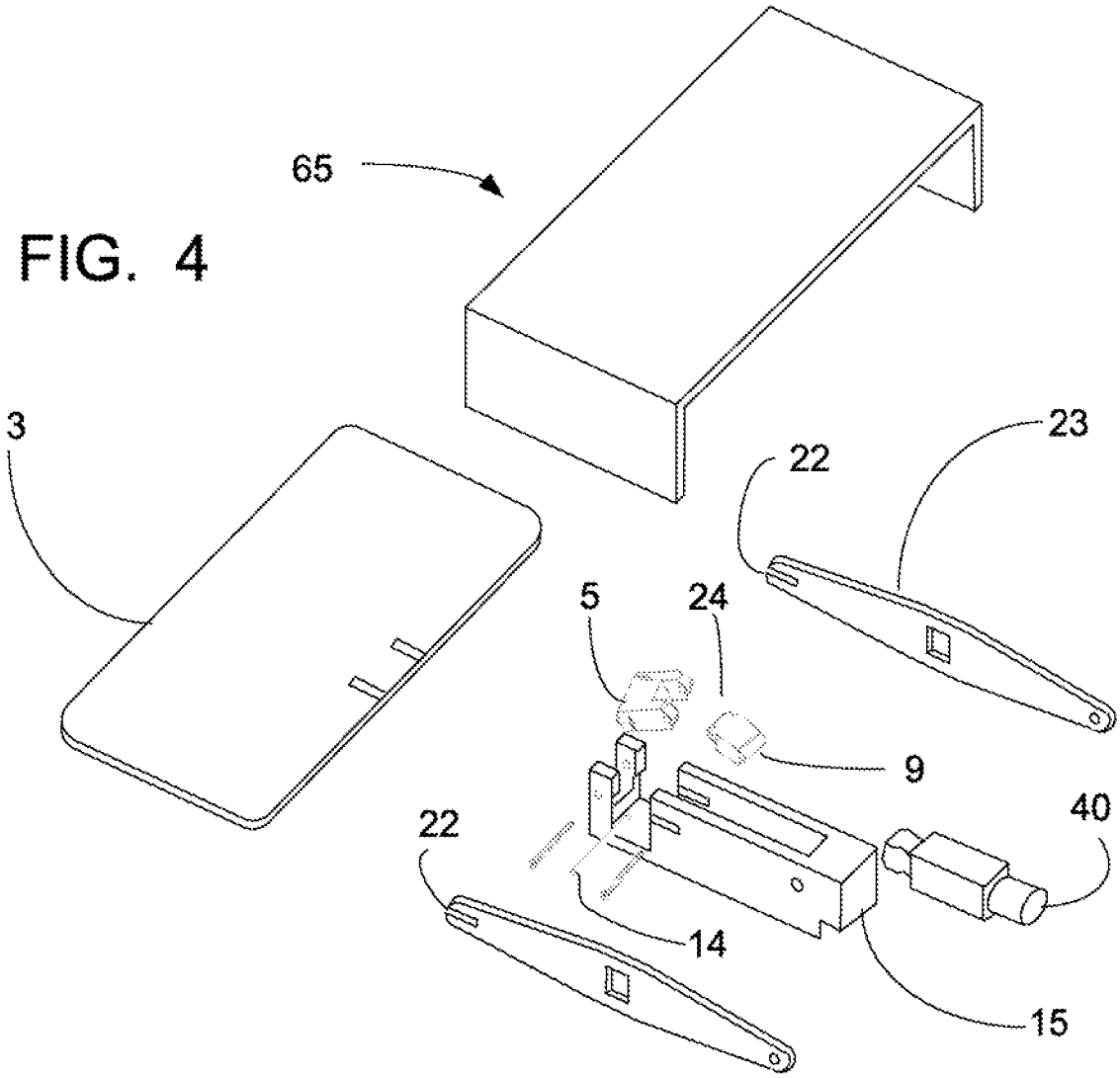
FIG. 4 is an exploded view of the spark generation assembly of FIG. 3.
Figure 5:
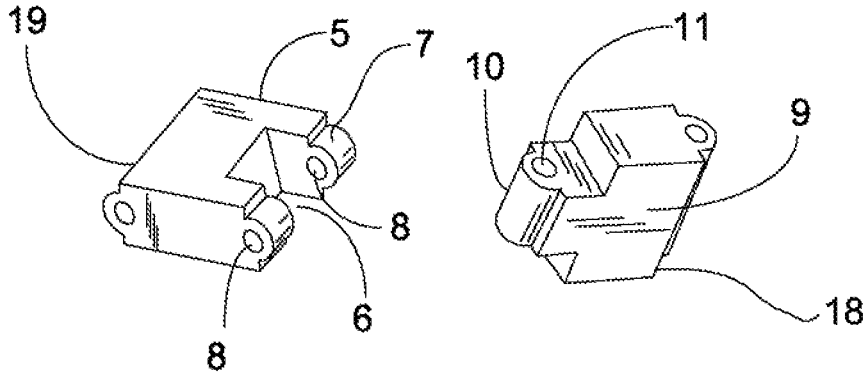
FIG. 5 depicts the two link members that actuate the piezo igniter.
Figure 6:
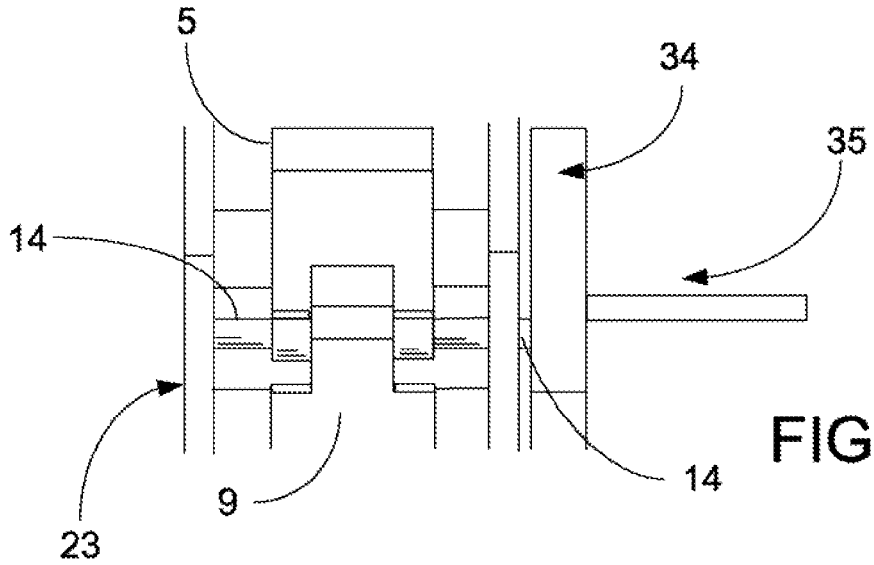
FIG. 6 is a top view of the spark generation assembly and the associated gas flow directing valve.
Figure 7:
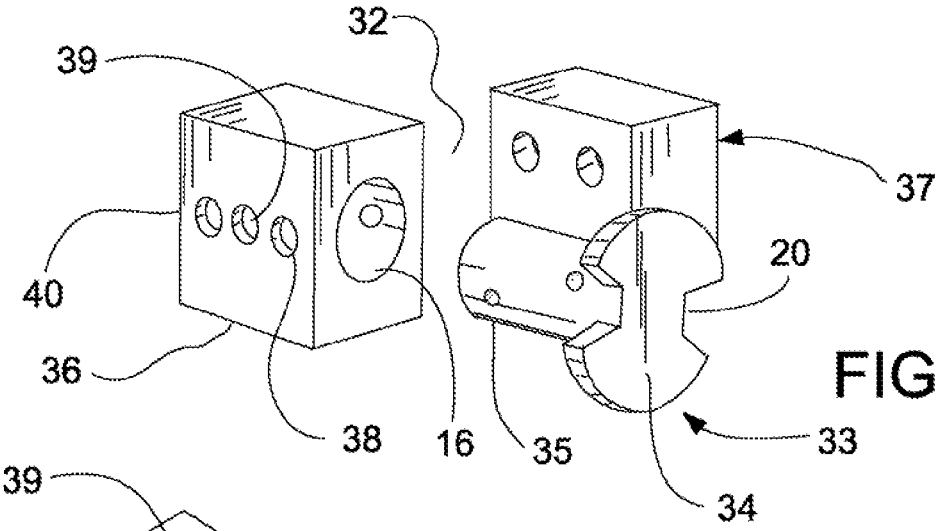
FIG. 7 is an exploded view of the gas flow directing valve and associated components.
Figure 8:
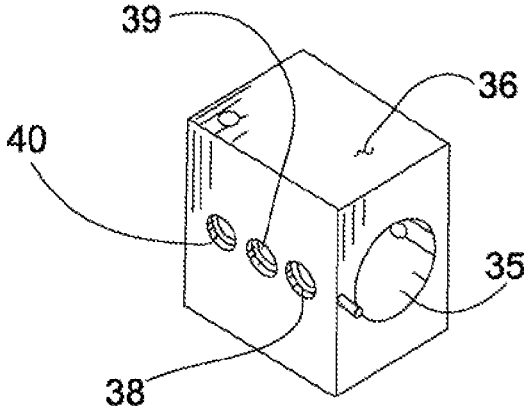
FIG. 8 is an isolated view of the gas flow directing valve housing.
Figure 9:
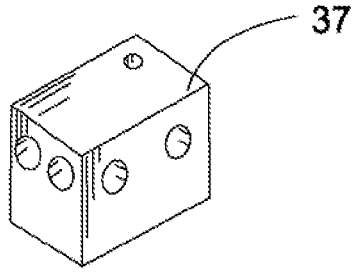
FIG. 9 is an isolated view of the manifold.

The present invention relates to an ignition assembly for a gas-fueled appliance such as a lamp. The device is preferably constructed of a suitable shape, dimension, aesthetic and configuration so as to be easily and inconspicuously incorporated within an existing or newly manufactured lamp. The ignition assembly comprises a base plate 1 having an upper surface and a lower surface. The base plate supports a spark generation assembly, designated generally as 85, which includes an upper bellows 2 and a lower bellows 3 with a pressure plate 4 disposed therebetween. A substantially U-shaped cover 65 conceals and protects the bellows and interposed pressure plate, and preferably has a similar aesthetical configuration as the lamp. A front edge of the pressure plate is received within a slot 22 on each of two spaced actuator arms 23. Mounted between the actuator arms is a toggle linkage assembly 24 that drives a spark generator 40 described in more detail, infra.

Now referring to FIGS. 3-6, the toggle linkage assembly is formed of a pair of link members, a first 5 of which includes a U-shaped receptacle 6 defined by a pair of spaced flanges 7 each having an aperture 8 formed thereon. A second link member 9 includes a protrusion 10 that fits within the U-shaped receptacle. The protrusion likewise includes an aperture 11 that aligns with the flange apertures of the first link member. A pin 14 is inserted into the aligned apertures with each of two opposing ends of the pin being pivotally connected to one of the actuator arms. The end 19 of the first link member opposite the U-shaped receptacle is pivotally fastened to a casing 15 that houses the piezo igniter; the end 18 of the second link member opposite the protrusion is pivotally attached to the piezo igniter.

When in a static position, the link members assume either a substantially V-shaped, or an inverted V-shaped orientation depending upon the position of the actuator arms. As the actuator arms are moved upwardly due to inflation of the lower bellows, the toggle linkage assembly initially expands to a substantially linear, "toggle" position whereby the piezo igniter moves against a crystal structure to create a spark. Once in the toggle position, the spring-biased piezo igniter forces the intermediate portion of the linkage assembly upwardly and the link members assume an inverted V-shaped orientation.

As the upper bellows is inflated and the actuator arms move downwardly, the toggle linkage assembly again expands to a substantially linear, "toggle" position creating another spark. The spring-biased piezo igniter then forces the intermediate portion of the linkage assembly downwardly and the link members reassume a V-shaped orientation.

Now referring to FIGS. 6-12, the linkage assembly operates a rotating gas flow directing valve 32 that delivers gas from a fuel source 80 to either the upper bellows or the lower bellows while simultaneously deflating the other depending upon the linkage assembly position. The gas flow directing valve includes a rotor 33 having a rotor head 34 with a rotor shaft 35 extending therefrom. The pin 14 that joins to the two link members extends through one of the actuator arms and rides within one of two diametrically opposed notches 20 on the rotor head. Accordingly, either upward or downward movement of the linkage assembly rotates the rotor in one of two directions. The notches assure that the rotor is only engaged after the toggle linkage assembly surpasses the toggle point so that the valve is not needlessly actuated until necessary.

Figure 10:
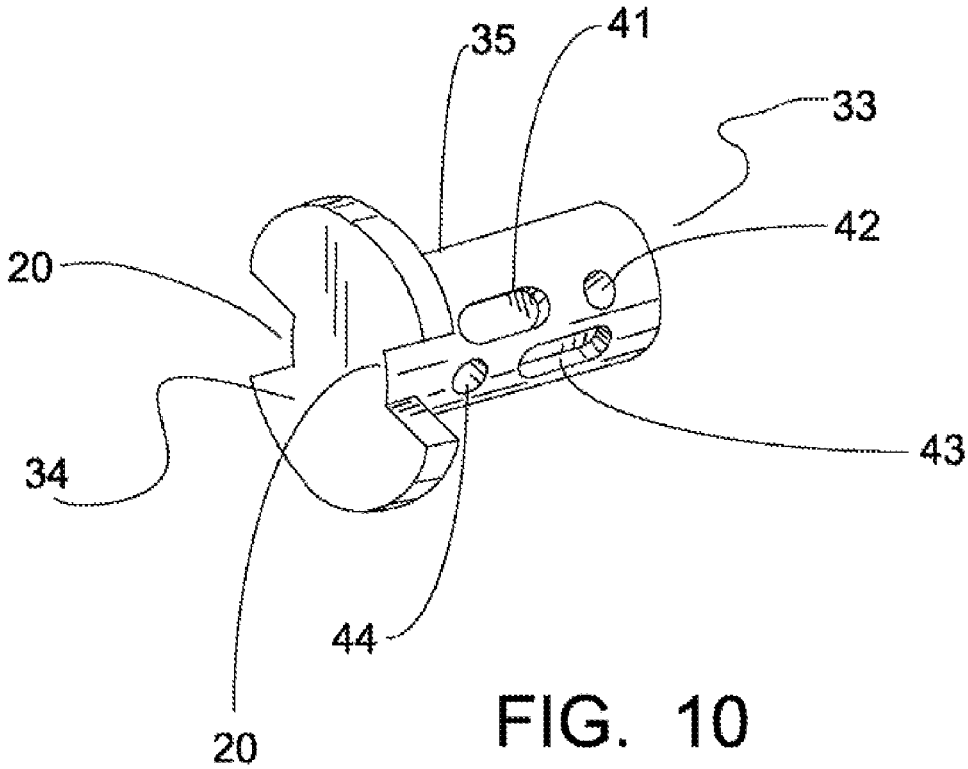
FIG. 10 is a perspective, isolated view of the gas flow directing valve rotor.
Figure 11:
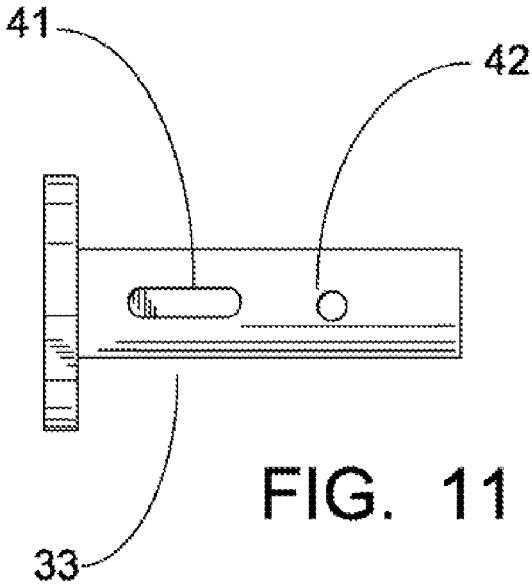
FIG. 11 depicts the directing valve rotor oriented to vent the upper bellows and to simultaneously inflate the lower bellows.
Figure 12:
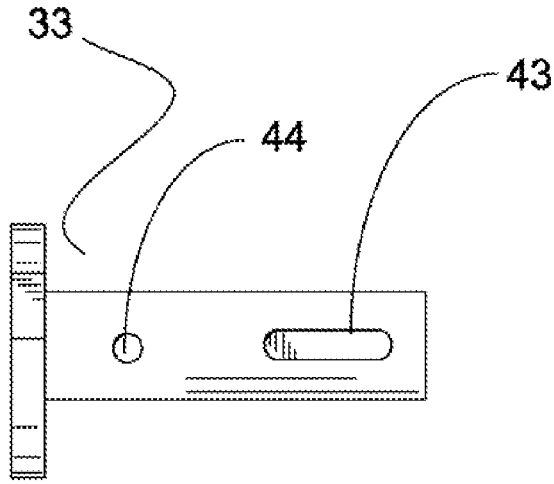
FIG. 12 is a plan view of the rotor of FIG. 11 reoriented to vent the lower bellows and to simultaneously inflate the upper bellows.

The rotor shaft is received within a central bore 16 formed within a valve housing 36. A manifold 37 in fluid communication with the fuel gas source 80 is positioned immediately adjacent the valve housing. The valve housing includes a first port 38 in fluid communication with the upper bellows, a second port 39 in fluid communication with a vent 30 and a third port 40 in fluid communication with the lower bellows. A first, wide-profile venting slot 41 and a first gas delivery port 42 are positioned on the shaft; the first venting slot 41 is proximal the rotor head while the delivery port is positioned on an intermediate portion of the shaft. A second venting slot 43 and gas delivery port 44 are circumferentially spaced from the first slot and port, and are reversely oriented relative thereto, as depicted in FIGS. 10-12, i.e., with the delivery port 44 proximal the rotor head and the slot 43 on an intermediate portion of the shaft.

Therefore, as the linkage assembly rotates the shaft to a first position, the first venting slot aligns with both the upper bellows port and the vent port to direct gas flow from the upper bellows interior to the vent. When the shaft is rotated to a second position, the second venting slot simultaneously aligns with the vent port and the lower bellows port to divert gas therefrom to the vent. The venting slots and ports are positioned to deflate a respective bellows immediately after inflation so that gas may be immediately delivered to the other bellows for re-inflation. Accordingly, each time the linkage assembly is actuated, one of the venting slots and the adjacent port are properly aligned within the valve housing ports to deliver fuel gas from the inflated bellows to the vent.

The vent 30 is formed of a tower having a fuel gas dispensing tip 92 at an upper end. The dispensing tip includes both a venturi to thoroughly mix the fuel gas with ambient air and a diffuser that widely disperses the effluent fuel gas to enhance ignition.

Accordingly, fuel gas inflates the lower bellows while the gas flow direction valve simultaneously deflates the top bellows by diverting gas therein to the vent. As the lower bellows inflates, the pressure plate and associated linkage assembly is propelled upwardly to the "toggle" position thereby causing the piezo igniter to create a spark. The return spring associated with the piezo igniter forces the linkage upwardly which rotates the flow directing valve to reverse the gas flow. Accordingly, fuel gas is immediately directed to the top bellows and the fuel gas within the bottom bellows is directed to the vent tip. As the top bellows is inflated, the linkage assembly is forced downwardly to create a second spark. The return spring forces the linkage downwardly, rotating the valve to its second position to re-inflate the bottom bellows and vent the top bellows.

Figure 13:
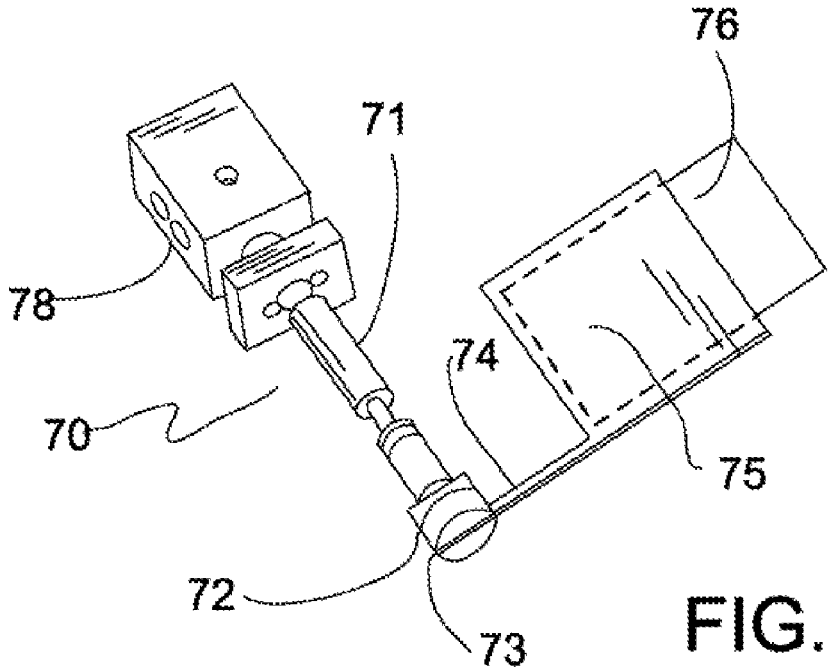
FIG. 13 is an isolated view of the gas disabling means.
Figure 14:
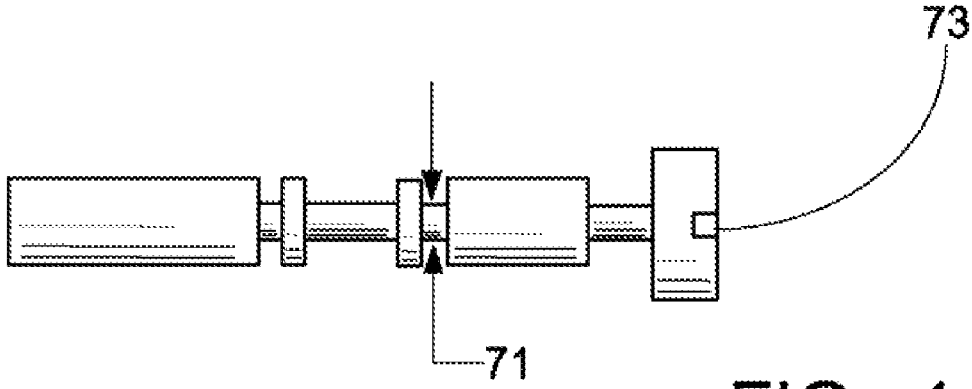
FIG. 14 is an isolated view of the shutoff valve pin forming part of the gas disabling means.

Now referring to FIGS. 13 and 14, the device includes a gas disabling means for disabling gas flow in the event a flame is not generated within a predetermined time period. The disabling means includes a shutoff valve 70 formed of a valve casing 78, in fluid communication with the fuel gas supply, having a pin 71 received therein; the pin either enables or disables gas flow through the valve casing 78 depending upon its position. The pin includes a cap 72 with a slot 73 thereon that receives a lever 74 extending from an actuator panel 75; an inflatable bladder 76 is positioned beneath the actuator panel that moves the panel upwardly and downwardly. A thermal expansion valve 77, when opened, delivers fuel gas from the fuel gas source to the bladder causing it to inflate.

Figure 15:
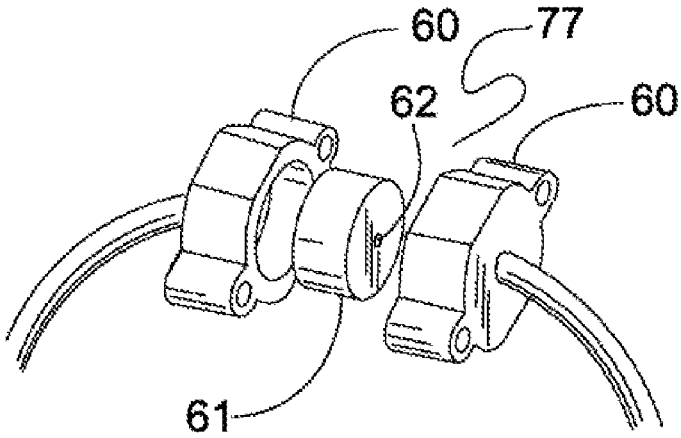
FIG. 15 is an isolated, exploded view of the thermal expansion valve.

Referring specifically to FIG. 15, the thermal expansion valve is constructed of a rigid outer casing 60 with a rubber insert 61 received therein. Fuel gas from the shutoff valve flows through a centrally disposed, small-diameter orifice 62 on the insert to both the bladder 76 and the spark generation assembly 85 described above. The insert, when heated to a predetermined temperature, i.e., approximately 47 degrees Celsius, will initially attempt to expand within the immovable outer casing. The insert's inability to expand outwardly will cause the centrally-disposed orifice to close thereby disabling gas flow to the bladder and the spark generator.

Accordingly, the heat generated by a flame created within the appliance will close the orifice thereby disabling gas flow to both the spark generation assembly and the shutoff valve bladder. However, if repeated sparks are generated without creating a flame, the thermal valve will remain open until the bladder is inflated sufficiently to displace the actuator panel to a position that closes the shutoff valve. If a flame is created and the thermal valve closes, the bladder eventually deflates via a capillary thereby resetting the shutoff valve. However, if the valve had previously been fully engaged to disable gas flow, it must be manually reset prior to subsequent use since bladder deflation would not generate sufficient force to re-open the valve. The time required to inflate the bladder, and thus disable gas flow to the spark generator, can be precisely controlled by varying the length of a capillary tube extending from the thermal valve to the bladder.

A flame is created in the above-described ignition assembly as follows. As either of the bellows is inflated, the linkage assembly is propelled to activate the piezo igniter thereby creating a spark. The created spark is directed to the terminus of one or more electrodes 58 positioned adjacent the vent tip 92. The flame created at the vent tip then ignites the main burner 50 positioned adjacent thereto.

Although the above-described ignition system has been primarily depicted and described as being suitable for a gas lamp, the device could also be incorporated into many other gas-fueled appliances. As is readily apparent to those skilled in the art, the present invention provides an ignition assembly that eliminates the need for external power sources or manual ignition procedures thereby providing a cheaper, more efficient, and less laborious means for igniting gas-fueled appliances.

The above described device is not limited to the exact details of construction and enumeration of parts provided herein. Furthermore, the size, shape and materials of construction of the various components can be varied.

Although there has been shown and described the preferred embodiment of the present invention, it will be readily apparent to those skilled in the art that modifications may be made thereto which do not exceed the scope of the appended claims. Therefore, the scope of the invention is only to be limited by the following claims.

What is claimed is:

1. An ignition assembly for a gas-fueled appliance comprising:

a movable spark generation means for creating a spark when displaced;

a linkage means movable between a first position and a second position for propelling said spark generation means when said linkage means is moved into either of said first position and said second position;

an automated drive means for automatically moving said linkage means between either of said first position and said second position to create a spark proximal an ignition site, wherein said automated drive means comprises (i) an upper bellows and a lower bellows with a pressure plate positioned therebetween, said pressure plate connected to said linkage means, said upper bellows and said lower bellows in selective fluid communication with a fuel gas source, and (ii) fuel transport means for delivering fuel gas to a select one of said upper bellows and said lower bellows and for simultaneously removing fuel gas from another of said lower bellows and said upper bellows whereby either of said upper bellows and said lower bellows inflates to vertically propel said pressure plate which moves said linkage means into either of said first position and said second position to create a spark;

means for disabling fuel gas flow to said upper bellows and said lower bellows upon a flame being generated at the ignition site.

2. The ignition assembly according to claim 1 further comprising means for disabling fuel gas flow to said upper bellows and said lower bellows if a flame is not generated at the ignition site within a predetermined time period.

3. The ignition assembly according to claim 1 wherein said means for disabling fuel gas flow to said upper bellows and said lower bellows upon a flame being generated at the ignition site comprises a thermal valve positioned between said fuel source and said bellows, and proximal said ignition site, whereby a flame generated at said ignition site heats said thermal valve causing said thermal valve to close.

4. The ignition assembly according to claim 2 wherein said means for disabling fuel gas flow to said upper bellows and said lower bellows if a flame is not generated at the ignition site within a predetermined time period comprises:

an inflatable bladder in fluid communication with said fuel source;

a shutoff valve coupled with said fuel source, said valve including an actuator plate that moves said valve between an open position and a closed position, said actuator plate positioned on said bladder whereby continuous gas flow to said bladder for a predetermined time period will inflate said bladder to sufficiently propel said actuator arm to move said shutoff valve to said closed position.

5. An ignition assembly for a gas-fueled appliance comprising:

an upper bellows and a lower bellows;

a pressure plate positioned between said upper bellows and said lower bellows;

a pair of actuator arms connected to said pressure plate;

a toggling linkage assembly connected to said actuator arms, said linkage assembly movable between a first position and a second position;

a piezo spark generator attached to said linkage assembly that generates a spark whenever said toggling linkage assembly is moved into either of the first position and the second position;

means for selectively inflating either of said upper bellows and said lower bellows to vertically move said pressure plate, and said linkage assembly into either of said first position and said second position.

6. The ignition assembly according to claim 5 further comprising means for deflating either of said upper bellows and said lower bellows whenever another of said upper bellows and said lower bellows is being inflated.

7. An ignition assembly for a gas-fueled appliance comprising:

an upper bellows and a lower bellows;

means for establishing select communication between a fuel gas source and each of said bellows to inflate a select one of said bellows;

a pressure plate positioned between said upper bellows and said lower bellows;

a pair of actuator arms connected to said pressure plate;

a toggling linkage assembly connected to said actuator arms, said linkage assembly movable between a first position and a second position;

a piezo spark generator attached to said linkage assembly that generates a spark whenever said toggling linkage assembly is moved into either of the first position and the second position whereby inflation of said lower bellows moves said linkage assembly into said first position to create a spark, and inflation of said upper bellows moves said linkage assembly to said second position to create another spark.

8. The ignition assembly according to claim 7 further comprising means for automatically disabling gas flow from said gas source to said bellows if a flame is not successfully generated at an ignition site within a predetermined duration.

9. The ignition assembly according to claim 8 further comprising means for disabling gas flow from a gas source upon said spark generator successfully creating a flame at an ignition site.

10. The ignition assembly according to claim 7 further comprising means for selectively deflating one of said bellows as another of said bellows is being inflated by said fuel gas.

11. The ignition assembly according to claim 10 wherein said means for selectively deflating one of said bellows as another of said bellows is being inflated by said fuel gas is controlled by said linkage assembly.

12. The ignition assembly according to claim 9 wherein said means for disabling gas flow from a gas source upon said spark generator successfully creating a flame at an ignition site comprises a thermal valve mounted on said fuel source and proximal said ignition site whereupon heat generated by said flame closes said thermal valve.

13. The ignition assembly according to claim 11 wherein said means for selectively deflating one of said bellows as another of said bellows is being inflated by said fuel gas comprises:

a rotating gas-directing valve connected to said linkage means, said gas-directing valve movable between either of a first delivery position and a second delivery position, said valve in said first delivery position when said linkage assembly is in said first position, said gas-directing valve diverting fuel gas from a fuel gas source to said lower bellows, and diverting fuel gas within the upper bellows to a vent when said valve is in said first delivery position and said linkage assembly is in said first position, said valve diverting fuel gas from a fuel source to said upper bellows, and diverting fuel gas within said lower bellows to a vent when said valve is moved to said second delivery position and said linkage means is moved to said second position.

14. The ignition assembly according to claim 12 wherein said means for automatically disabling gas flow from said gas source to said bellows comprises:

an inflatable bladder in fluid communication with said fuel source;

a shutoff valve coupled with said fuel source, said valve movable between an open position and a closed position by a rotatable actuator, said actuator superimposed on said bladder whereby continuous flow of fuel gas for a predetermined duration inflates said bladder until said bladder rotates said actuator sufficiently to move said shutoff valve into the closed position.

15. An ignition assembly for a gas-fueled appliance comprising:

a movable spark generation means for creating a spark when displaced;

a linkage means movable between a first position and a second position for propelling said spark generation means when said linkage means is moved into either of said first position and said second position;

an automated drive means for automatically moving said linkage means between either of said first position and said second position to create a spark proximal an ignition site, wherein said automated drive means comprises (i) an upper bellows and a lower bellows with a pressure plate positioned therebetween, said pressure plate connected to said linkage means, said upper bellows and said lower bellows in selective fluid communication with a fuel gas source, and (ii) fuel transport means for delivering fuel gas to a select one of said upper bellows and said lower bellows and for simultaneously removing fuel gas from another of said lower bellows and said upper bellows whereby either of said upper bellows and said lower bellows inflates to vertically propel said pressure plate which moves said linkage means into either of said first position and said second position to create a spark, wherein said fuel transport means comprises a rotating gas-directing valve connected to said linkage means, said gas-directing valve movable between either of a first delivery position and a second delivery position, said gas-directing valve in said first delivery position when said linkage assembly is in said first position, said gas-directing valve diverting fuel gas from a fuel gas source to said lower bellows, and diverting fuel gas within the upper bellows to a vent when said valve is in said first delivery position and said linkage assembly is in said first position, said gas-directing valve diverting fuel gas from a fuel source to said upper bellows, and diverting fuel gas within said lower bellows to the vent when said gas-directing valve is moved to said second delivery position and said linkage means is moved to said second position.

* * * * *